US005149173A

United States Patent [19]

Jay et al.

[11] Patent Number: 5,149,173

[45] Date of Patent: Sep. 22, 1992

[54] BOLSTER WITH IMPROVED ATTACHMENT MEANS

[75] Inventors: Eric C. Jay, Boulder; Richard R. Runkles, Englewood, both of Colo.

[73] Assignee: Jay Medical, Ltd., Boulder, Colo.

[21] Appl. No.: 766,679

[22] Filed: Sep. 27, 1991

Related U.S. Application Data

[63] Continuation-in-part of Ser. No. 607,527, Nov. 1, 1990, which is a continuation-in-part of Ser. No. 272,137, Nov. 16, 1988, abandoned.

[51] Int. Cl.[5] ..... A47C 7/46

[52] U.S. Cl. ..... 297/284.9; 297/DIG. 6

[58] Field of Search ..... 297/284 D, 284 F, 285 G, 297/DIG. 6, 460, 459

[56] References Cited

U.S. PATENT DOCUMENTS 2,822,033 2/1958 Dixon ..... 297/284 G X
4,161,337 7/1979 Ross et al. ..... 297/284 G X
4,876,755 10/1989 Parrish ..... 297/284 D X
5,018,790 5/1991 Jay ..... 297/457 X

FOREIGN PATENT DOCUMENTS 1173209 12/1969 United Kingdom ..... 297/284 G

*Primary Examiner*—Peter R. Brown
*Attorney, Agent, or Firm*—Cook, Egan, McFarron & Manzo, Ltd.

[57] ABSTRACT

A wheelchair back system is disclosed having a bolster with an improved mounting means. The bolster has a rear surface which is positioned on a lateral portion of the wheelchair back. A strap attached to the front surface of the bolster extends to and engages the front surface of the back, toward the center of the back. The strap provides the bolster with enhanced resistance to lateral forces which may be applied to the bolster during the use of the wheelchair.

12 Claims, 6 Drawing Sheets

BOLSTER WITH IMPROVED ATTACHMENT MEANS

This application is a continuation-in-part of U.S. application Ser. No. 607,527 filed Nov. 1, 1990, which is a continuation-in-part of U.S. application Ser. No. 272,137, filed Nov. now abandoned.

The present invention relates to a seat back system for wheelchairs which provides an improved means for attachment of bolsters. The seat back system of the present invention further provides for height adjustability of the back, adjustment of the tilt of the back, a lumbar support which may be positioned to fit the specific height required by the wheelchair user independent of the height of the back, and provides for contoured, adjustable lateral support. The back system may be readily attached to or detached from a wheelchair, in order to fold up the wheelchair for transportation or storage. The wheelchair back system may be used on new wheelchairs and may be retrofitted on existing wheelchairs to replace existing back structures.

BACKGROUND OF THE PRESENT INVENTION

Many of the problems faced by wheelchair users and particularly the paraplegics are kyphosis, scoliosis, instability, redness of the spine, and pain of the back which conditions are aggravate by soft, curved 37 sling" upholstery conventionally used in wheelchairs.

The present invention replaces the conventionally used wheelchair back upholstery with a comfortable, sturdy, adjustable, supportive, pressure relieving, easy-to-use back system designed to attack back problems.

Kyphosis

Kyphosis, probably the most common back deformity, is a rounding of the spine in a 37 humpback" posture and is often combined with a 37 slouching" posture, with the hips sliding away from the back of the wheelchair. This condition is most common among older patients, but is rapidly becoming a problem among young paraplegics and quadriplegics sitting against low 37 sport" backs that sag after a few months' use.

The back system of the present invention is firm, to prevent sagging of the back, and it is contoured to conform to the natural curvature of the back and to provide lateral stability. Additionally, a built-in lumbar support allows the user to sit straighter, thus preventing rounding of the back and resulting kyphosis.

Scoliosis

Scoliosis, an 37 S" curvature of the spine, is most frequently developed by females. It is often caused by a non-supportive sitting base that encourages pelvic obliquities (uneven hips) and aggravated by wheelchair back that does not provide support from side to side.

The back system of the present invention supports against side to side leaning and the development of scoliosis in three ways:

1. By restoring the lumbar curve of the user, it mechanically stabilizes the spine of the user to reduce the tendency to lean to one side;

2. By totally conforming to the back of the user, it naturally grips the user's back to provide natural lateral support; and 3. By allowing VELCRO attachment of contoured lateral supports, the user can take advantage of the most comfortable, unobtrusive lateral supports available today.

Instability

The tendency to fall from side to side or to fall forward is common among users with head injuries, multiple sclerosis, quadriplegics and other disabilities where there is an impairment of cognitive or nerve function. To prevent this tendency, these patients tend to slouch in their wheelchairs in order to lower their center of gravity and gain stability. This slouching may result in kyphosis, aggravated back pain, coccygeal pressure sores, and improper leg positions.

The back system of the present invention is scientifically contoured to hug the back of the user, thus enabling the user to sit up straight. The contoured lateral supports provide the user with a stable back which allows the user to sit taller in the wheelchair, with less fear of falling.

Redness of the Spine

The spine is a series of bony protrusions that are subject to pressure, shearing and abrasion - and a resulting skin redness and breakdown. The most prevalent problems come with kyphosis and scoliosis, which can accentuate a bony prominence. Skin breakdown can also result from an extreme weight loss or a gibbus deformity (where the spine is fused after a break).

The back system of the present invention reduces the outward protrusion of the spine, by sitting the user straighter. In addition, a fluid filled pad is inserted up and down the middle of the back, to solve pressure problems where they are most likely to occur—on the spine. Additionally, a $\frac{1}{4}$-$\frac{1}{2}$ inch layer of reticulated open cell foam behind the cover increases comfort and reduces pressure on shoulder blades and other bony protrusions.

Back Pain

Back pain is undoubtedly the most common back complaint. It can be caused by any of the factors mentioned above. The most common cause, however, is a backward tilt of the pelvis, a loss of the natural lumbar curve, and the resulting strain placed on the spine and on connecting muscles.

The back system of the present invention reduces back pain by pushing the pelvis into a forward tilt, thus restoring the natural lumbar curve and reducing the stress on the user's back.

The back system of the present invention also provides a universal mounting system which will accommodate wheelchairs having differing widths, wherein the vertical posts are spaced at different distances, it will accommodate posts of different diameter, and it will accommodate posts which have a different tilt or curvature. This allows the back system of the present invention to be retrofitted on existing wheelchairs, as well as installed as original equipment on new wheelchairs. Moreover, the mounting system which forms a part of the present invention allows ready removal of the back system in order to collapse the chair for transportation or storage and provides for easy reinstallation to produce a stable wheelchair back.

BRIEF DESCRIPTION OF THE PRESENT INVENTION

The present invention provides a wheelchair back system having an improved means for attachment of bolsters with a high degree of support and adjustability in order to accomplish various therapeutically significant functions, while at the same time providing a wheelchair back system which has a streamlined appearance and is generally aesthetically pleasing.

Specifically, the wheelchair back system of the present invention provides improved means for attachment of bolsters on a back which may be raised and lowered to accommodate the stabilization needs of the patient; it may be tilted forward or to the rear to accommodate the needs of the wheelchair user; it may include an adjustable height lumbar support; and a unique spinal protection device; in addition to adjustable side bolsters to provide back support and stability as may be needed by a wheelchair user.

In the preferred embodiment, the seat back system includes a pair of bolsters removably attached to the lateral portions the front surface of the seat back by complimentary VELCRO strips. Improved attachment of the bolsters is provided by a strap which engages the front surface and engages the front surface of the back. The addition of the strap increases the resistance of the bolster to lateral forces and thus provides enhanced attachment of the bolster to the seat back system. The bolster attachment means thus provides for ready adjustment of position of the bolsters.

In the preferred embodiment, the back system of the present invention further provides for easy disengagement of the back system when the wheelchair is folded up for transportation or storage; a wheelchair back system with a cover which may be readily removed for laundering; and a wheelchair back system that may be retrofitted on existing wheelchairs, as well as fitted as original equipment on wheelchairs.

DESCRIPTION OF THE DRAWINGS

In order that the invention may be more readily understood including the various embodiments of the invention, references made to the accompanying drawings in which.

DETAILED DESCRIPTION OF THE PREFERRED EMBODIMENT OF THE PRESENT INVENTION

Figure 3:
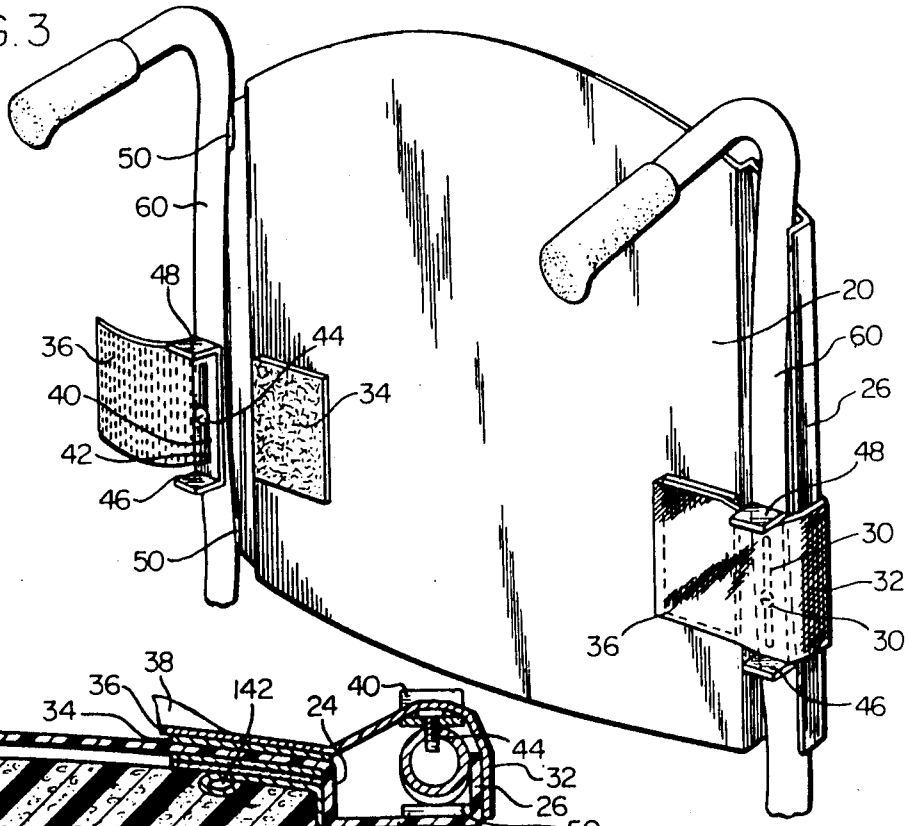
FIG. 3 is an isometric rear view of the wheelchair back system showing the attachment of the hard shell to the vertical wheelchair posts.

The improved bolsters and bolster mounting system of the present invention may be used with virtually any form or style of wheelchair back, and particularly those styles of wheelchair back which include a relatively rigid back member.

The description which follows, is directed to the preferred embodiment of the wheelchair back system presently contemplated by the inventors, but it should be understood that the present invention is not limited to any specific embodiment of back system.

The wheelchair back system of the present invention generally comprises plastic shell 20 and mounting system 30 which is used to affix plastic shell 20 to vertical posts 60 of a wheelchair. Mounting system 30 attaches shell 20 to vertical posts 60 and provides for vertical adjustment of the plastic shell 20 with respect to posts 60.

Cushion 70 is removably attached to plastic shell 20 and serves to cushion the back of the wheelchair user. Vertical channel 80 in cushion 70 provides space for pad 90 which is filled with a flowable fluid and thus provides for protection of the spine, particularly in the thoracic region, for wheelchair users. Lumbar support 120 is affixed to cushion 70, preferably astride channel 80 and under flowable fluid filled pad 90. Lumbar support 120 is vertically adjusted along channel 80 of cushion 70.

Bolsters 130, which are removably attached to cushion 70, provide additional lateral support to the wheelchair user, if necessary. The improved bolster attachment means, comprising strap 132, more fully described below, provides improved lateral support to the wheelchair user.

Cover 140 is adapted to cover cushion 70 along with bolsters 130 and the lubmar support 120, etc., and extend around the edges of cushion 70, and lock between cushion 70 and plastic shell 20 when cushion 70 is mounted to plastic shell 20. Cover 140 thus provides the wheelchair back system with a streamlined, aesthetically desirable appearance.

Plastic Shell

Plastic shell 20 is a hard, relatively rigid, relatively inflexible matrix which extends between the wheelchair posts 60 and provides mechanical support for the back system. It may be produced by formed ABS plastic about 150–200 mils thick. In wheelchair back systems designed for adult use, plastic shell 20 should be about 17 inches from top to bottom. The overall width should be sufficient to extend from the outside edge of one vertical wheelchair post 60 to the outside edge of the opposite vertical wheelchair post 60. Plastic shell 20 preferably has a slight convex curvature to generally conform to the backward bend used by most wheelchair posts.

The lateral edges of plastic shell 20 preferably comprise U-shaped channels 22, which extend from the top to the bottom of plastic shell 20. Channels 22 are made up of inner leg 24 and outer leg 26. The pace between inner leg 24 and outer leg 26 should be wide enough to wrap around vertical posts 60 of different diameters and having different spacings. Accordingly, it is preferred that channels 22 be about 2 inches wide. Outer leg 26 of channel 22 preferably extends approximately to the rear of vertical posts 60 and provides side to side support for the back system. Outer leg 26 is also aesthetically designed to serve as a cover for vertical posts 60. Outer leg 26 may be shortened if desired for aesthetic purposes.

If plastic shell 20 has a slight convex curvature, channel 22 is also convex, but it is preferred that channel 22 have flat portions 28 at its upper and lower end in order to provide for a two point contact of the channel 22 against vertical post 60. Preferably, the flat portion 28 of the channel 22 will cooperate with spacers 50 in adjusting the tilt of the back system, as is described below.

It is contemplated that the inner legs 24 of channels 22 will abut the vertical posts 60 in those wheelchairs which are designated 17 inch wheelchairs. Similarly, it is contemplated that the outer legs 26 of channels 22 will abut the outer side of vertical posts 60 in 18 inch wheelchairs. It is contemplated that for wheelchairs having posts with nonstandard spacing, spacers may be employed to securely position vertical posts 60 with respect to legs 24 and 26.

The Mounting System

The mounting system used to attach the back to the wheelchair is a matter of choice, and the system selected will depend, in large measure, on the type of back employed preferred embodiment of the mounting system of the present invention is described below, but it is understood that other types of mounting systems may be used such as the mounting system described in U.S. patent application Ser. No. 607,552 filed Nov. 1, 1990 by Jay, et al.

Mounting system 30 is a "soft system" (i.e., it is essentially free of hardware components) and comprises straps 32 affixed to outer legs 26 and adapted to extend to the rear of vertical post 60 and extend along the back of plastic shell 20, over pad 34. Preferably, pad 34 is a rectangle of VELCRO affixed to the back of plastic shell 20, as shown in FIG. 3. Extension 36 of strap 32 is also fitted with a VELCRO surface on its forward side, where it is adapted to gauge or mate with pad 34 thus securing strap 32 around post 60. Preferably, strap 32 is about 4 inches wide. Extension 36 of strap 32 may include handle means 38 which facilitates disengaging extension 36 from pad 34. Strap 32 may be affixed to outer leg 26 by a variety of means which will be known to those skilled in the art.

Bracket 40 is affixed to vertical post 60 and is vertically adjustable thereon. Preferably, bracket 40 includes a vertical slot 42 through which screw 44 affixes bracket 40 to vertical post 60. Vertical adjustment of bracket 40 may be achieved by loosening the screw 44, and sling the bracket 40 upwardly or downwardly, as the screw 44 slides in slot 42 and tightening the screw when the desired elevation is achieved. Bracket 40 also includes lower shelf 46 and upper shelf 48 which straddle strap extension 36 and lock strap extension 36 in the desired elevation, thus causing the back to remain at the elevation selected through the adjustment of screw 44 in slot 42 of bracket 40.

Figure 5:
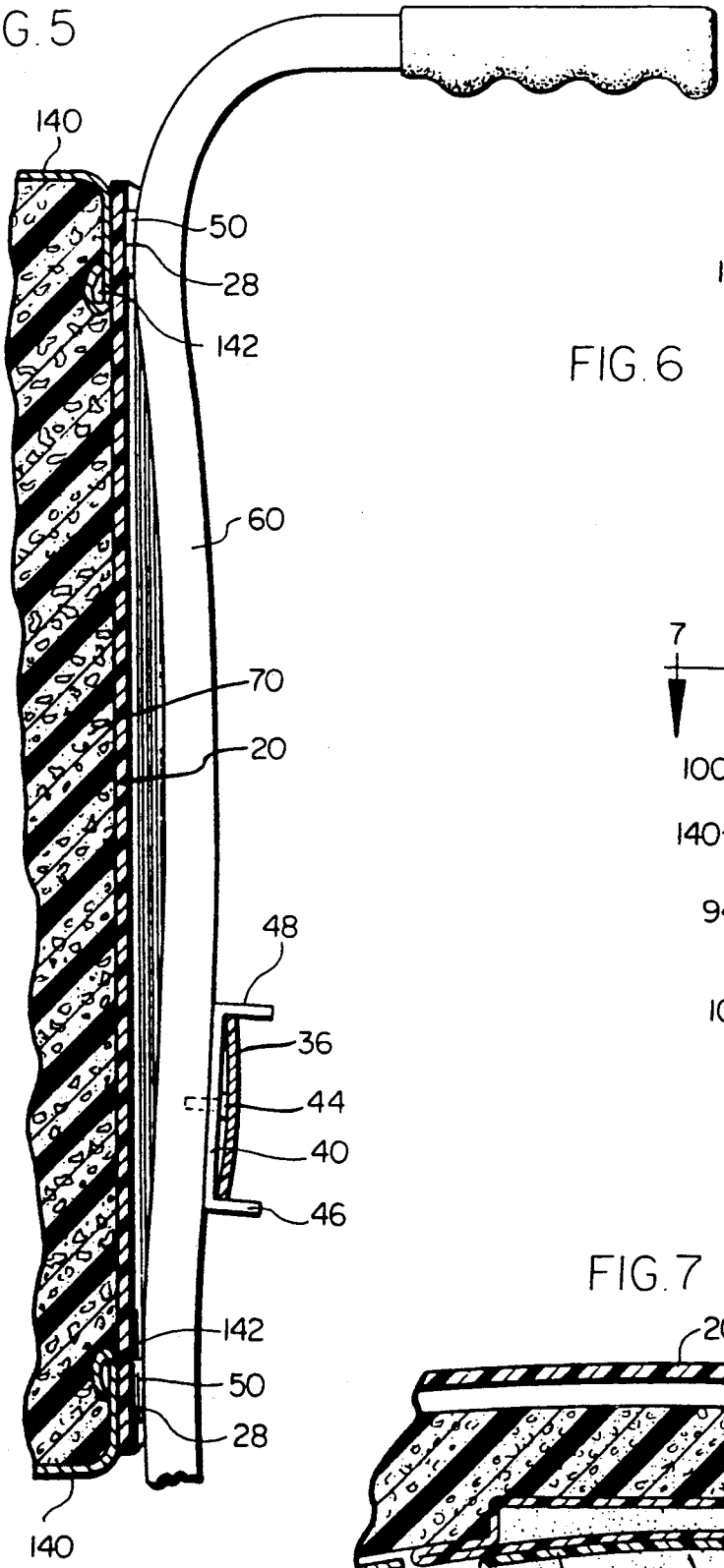
FIG. 5 is a cross-sectional side view of the wheelchair back system, taken at section 5—5 of FIG. 4.

Most wheelchair vertical posts 60 are arcuate in shape, as is shown in FIG. 5. Consequently, plastic shell 20, which may be essentially planar, contacts the vertical posts 60 at the top and the bottom. Thus the tilt (forward and backward) of the seat back system is to some extent a function of the particular curvature of vertical 60. The present invention contemplates the use of spacers 50 which are disposed in channel 22, at the top and bottom of channel 22, against flat portions 28, between plastic shell 20 and vertical posts 60. Conveniently, spacers 50 may be adhesively attached to plastic shell 20. In order to obtain tilt adjustment, spacers 50 are either removed or stacked upon one another to create the desired adjustment.

Figure 10:
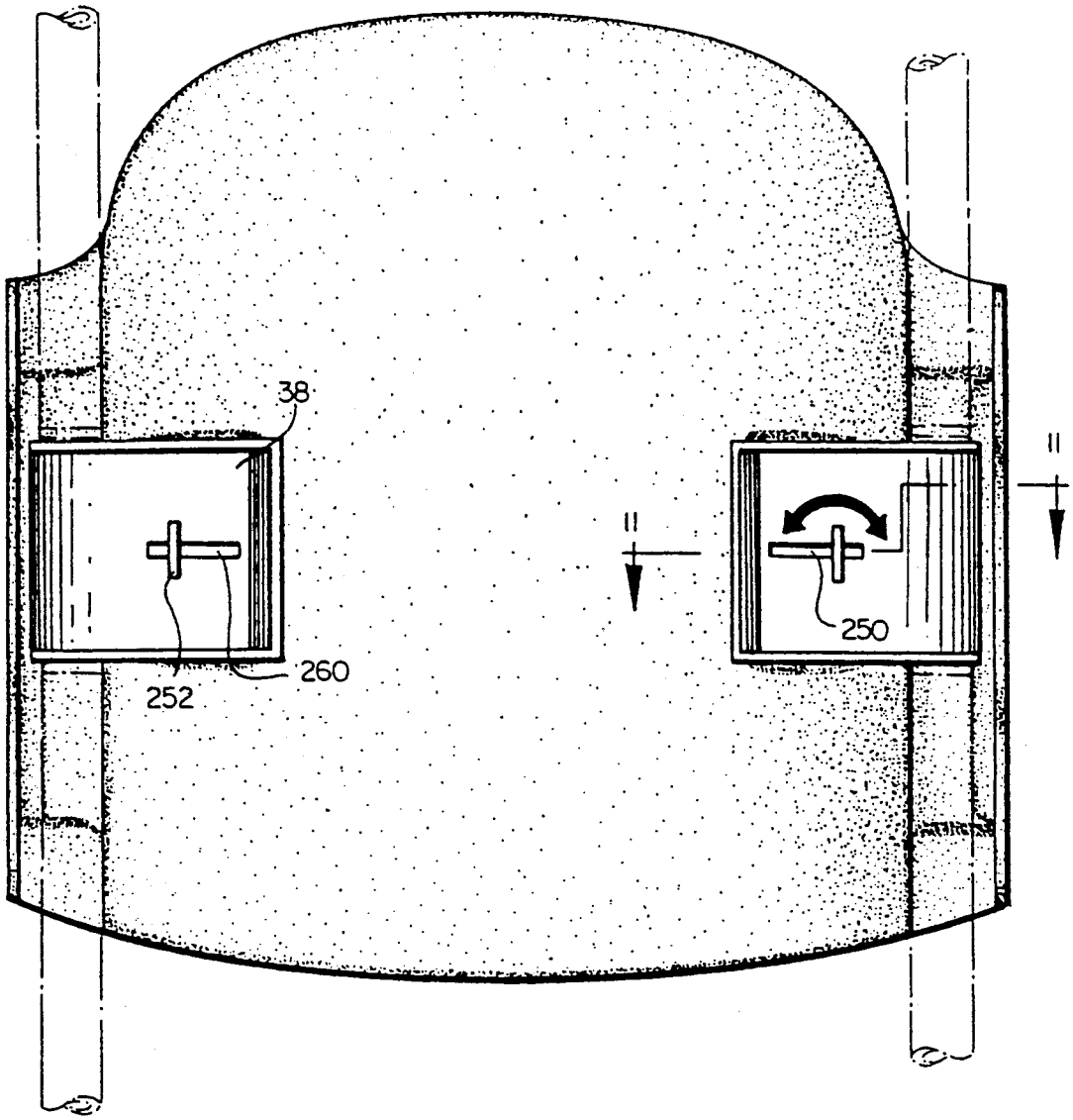
FIG. 10 is a rear view of the wheelchair back system, affixed to a wheelchair with the twist lock mounting system embodiment in the closed and locked position.
Figure 11:
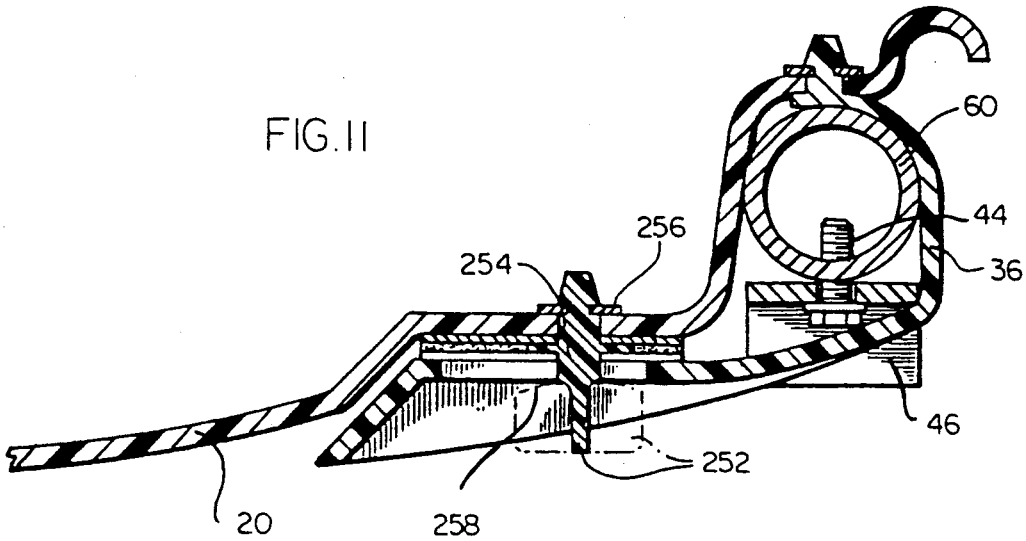
FIG. 11 is a top view, taken in Section 11—11 of FIG. 10 showing the twist lock mounting system embodiment in the locked position.

FIGS. 8–11 illustrate the twist lock mounting system embodiment. The twist lock 250 which comprises an operating member 252 which is attached to shank 254 which protrudes through an opening in rigid shell 20 and is rotatably secured to shell 20 by fastener 256. Handle means 238 is provided with slot 260. Slot 260 is wide enough to allow operating member 252 and shank 254 to pass through the slot, when the seat back is mounted on the wheelchair and handle 238 is moved to the latched position (and operating member 252 is in the horizontal position). When handle 238 is moved adjacent to rigid shell 20, the VELCRO strip on the front side of handle 238 engages VELCRO pad 34 on the rear of shell 20. Operating member 252 may be then rotated into the locked position (vertical position) as shown in FIG. 10. When the operating member 252 is in the locked position, the twist lock 250 prevents the VELCRO strip on the front of handle 238 from becoming disengaged from VELCRO pad 34.

In the preferred embodiment, twist lock 250 includes cam surface 258 on the lower side of operating member 252. Cam surface 258 is adapted to urge handle 238 toward rigid shell 20 as operating member 252, protruding through slot 260, is rotated from the horizontal, unlatched position to the vertical, latched position as shown in FIG. 10. The rotation of operating member 252 causes cam surface 258 to bear against the back of handle 238 and forces the VELCRO strip 237 on the front of handle 238 into contact with VELCRO pad 234, thus insuring that a good lock is obtained between the two VELCRO pieces. The action of cam surface 258 against the outside of handle 238 provides for enhanced contact between the VELCRO strip on the front side of handle 238 and VELCRO pad 234, thus providing improved security of the mounting of the seat back on the wheelchair.

The Cushion

Cushion 70 is preferably fabricated from a self-skinned polyurethane foam, although other materials may be used. Cushion 70 preferably extends into the well defined by plastic shell 20 between channels 22 and extends laterally beyond vertical posts 60. The height of cushion 70 should be approximately the same as the height of plastic shell 20. Thus a cushion of about $18 \times 18 \times 1$ inches is contemplated.

Figure 2:
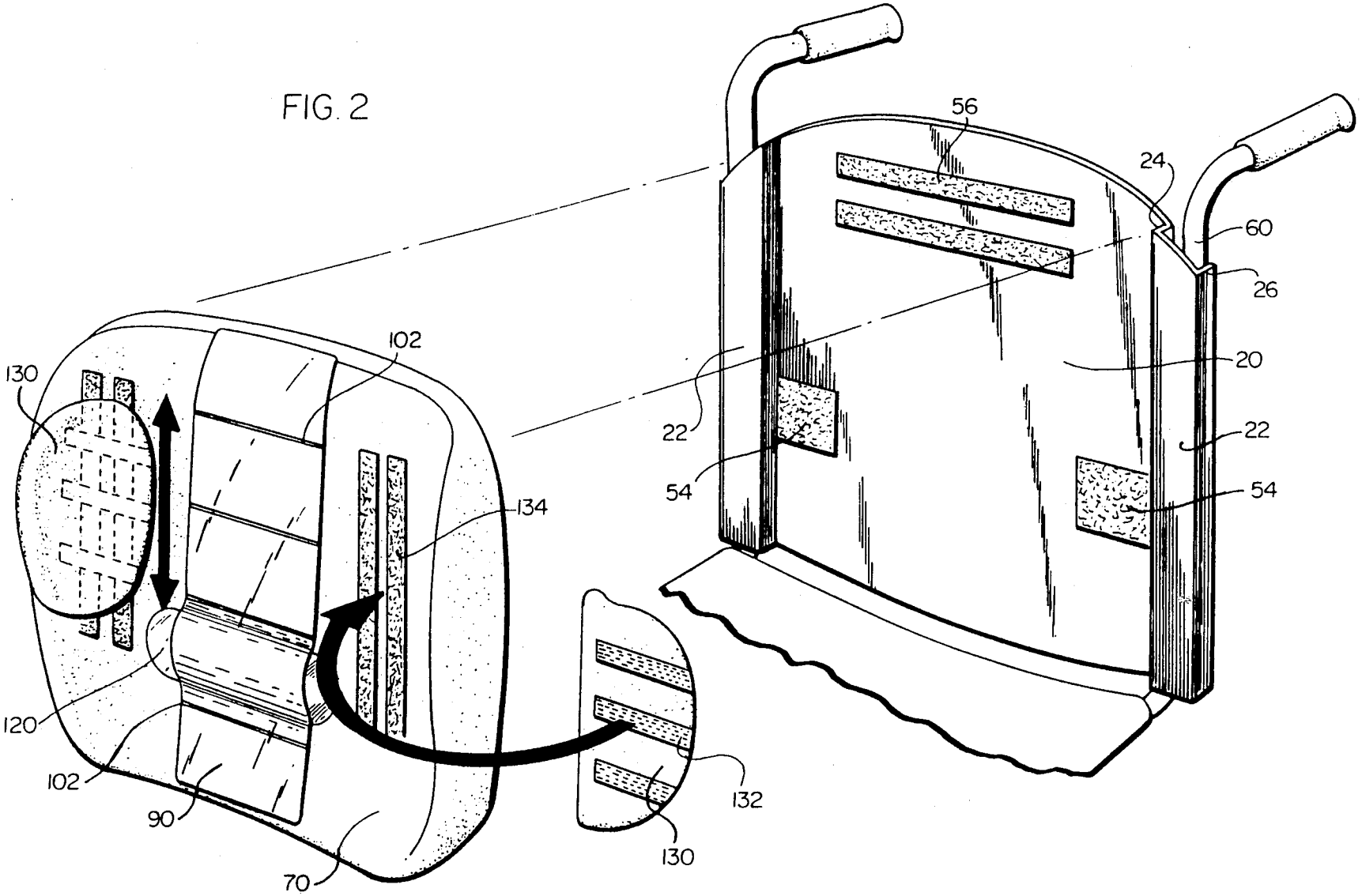
FIG. 2 is an isometric exploded front view of the wheelchair back system showing the cushion separated from the hard shell positioned on the vertical wheelchair posts.

Cushion 70 is preferably removably affixed to plastic shell 20 by a plurality of VELCRO closures. In the preferred embodiment, as shown by FIG. 2, side VELCRO strips 54 and top VELCRO strips 56 are affixed to plastic shell 20. Corresponding side VELCRO strips 72 and top VELCRO strips 74 are adhesively affixed to the back of cushion 70 and are adapted to engage side VELCRO strips 54 and top VELCRO strips 56 to removably affix cushion 70 to plastic shell 20.

The Channel

Channel 80 is vertically disposed along the center of cushion 70 and extends generally from the top of cushion 70 to the bottom, as shown in FIG. 2. Preferably, channel 80 is about 4 inches wide and about ½ inch deep, although the dimensions are not particularly critical. Similarly, the channel may be shorter, i.e., have a smaller height (measured from top to bottom) than the channel illustrated in FIG. 2.

Pad 90, which is filled with a flowable fluid, is positioned in channel 80 and preferably occupies substantially the entire volume of channel 80. VELCRO strips, not shown, are affixed to pad 90 and corresponding positions in channel 80, in order to secure pad 90 in channel 80.

Figure 6:
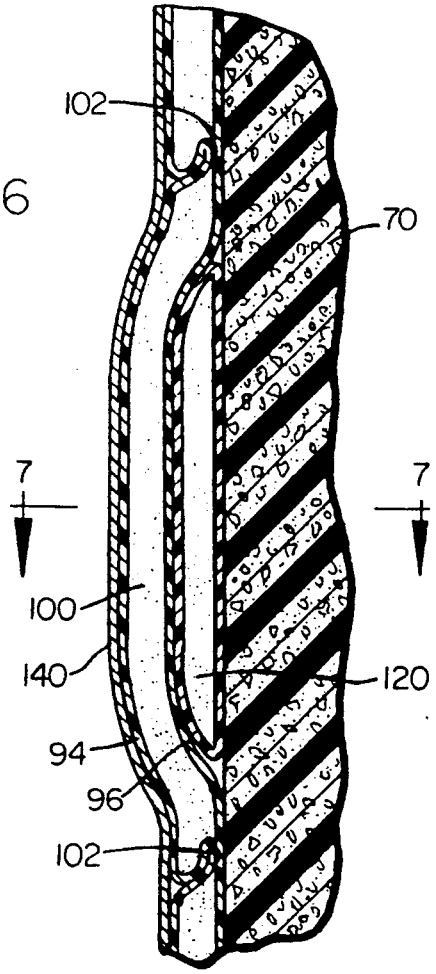
FIG. 6 is a fragmentary cross-sectional side view of the wheelchair back system, taken at section 6—6 of FIG. 1.
Figure 7:
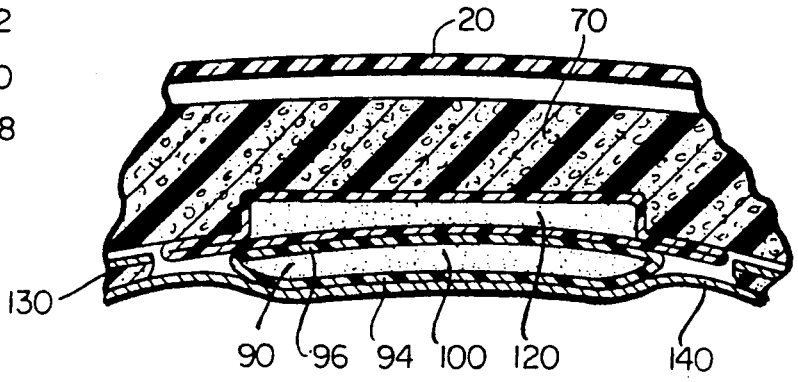
FIG. 7 is a fragmentary cross-sectional top view of the wheelchair back system, taken at section 7—7 of FIG. 6.
Figure 8:
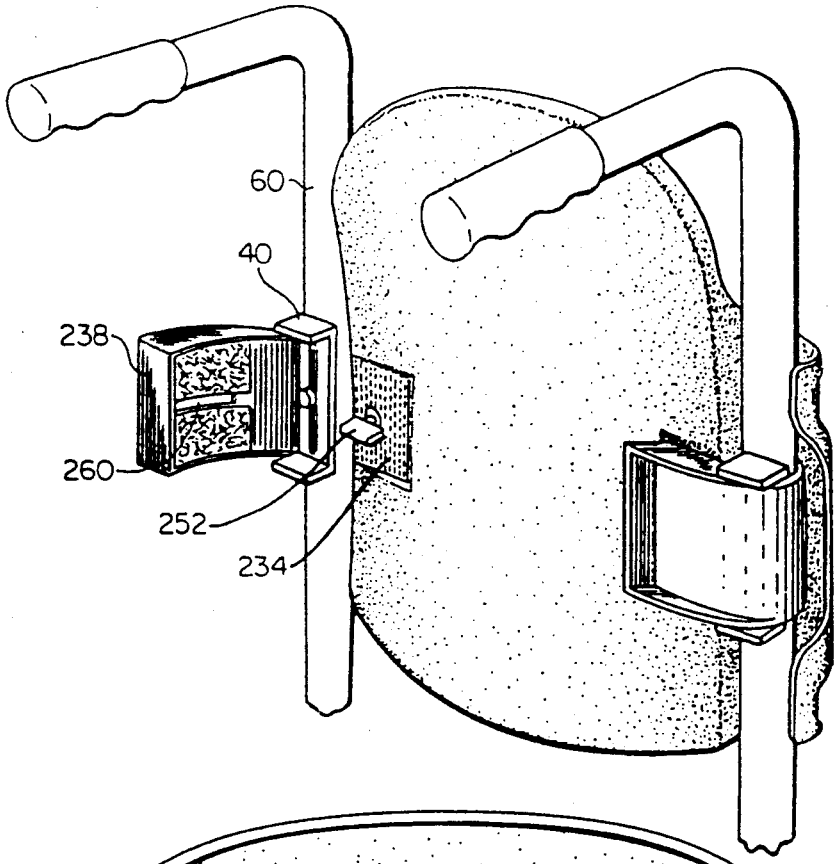
FIG. 8 is a isometric rear view of the wheelchair back system, affixed to the wheelchair, showing the twist lock mounting system embodiment.
Figure 9:
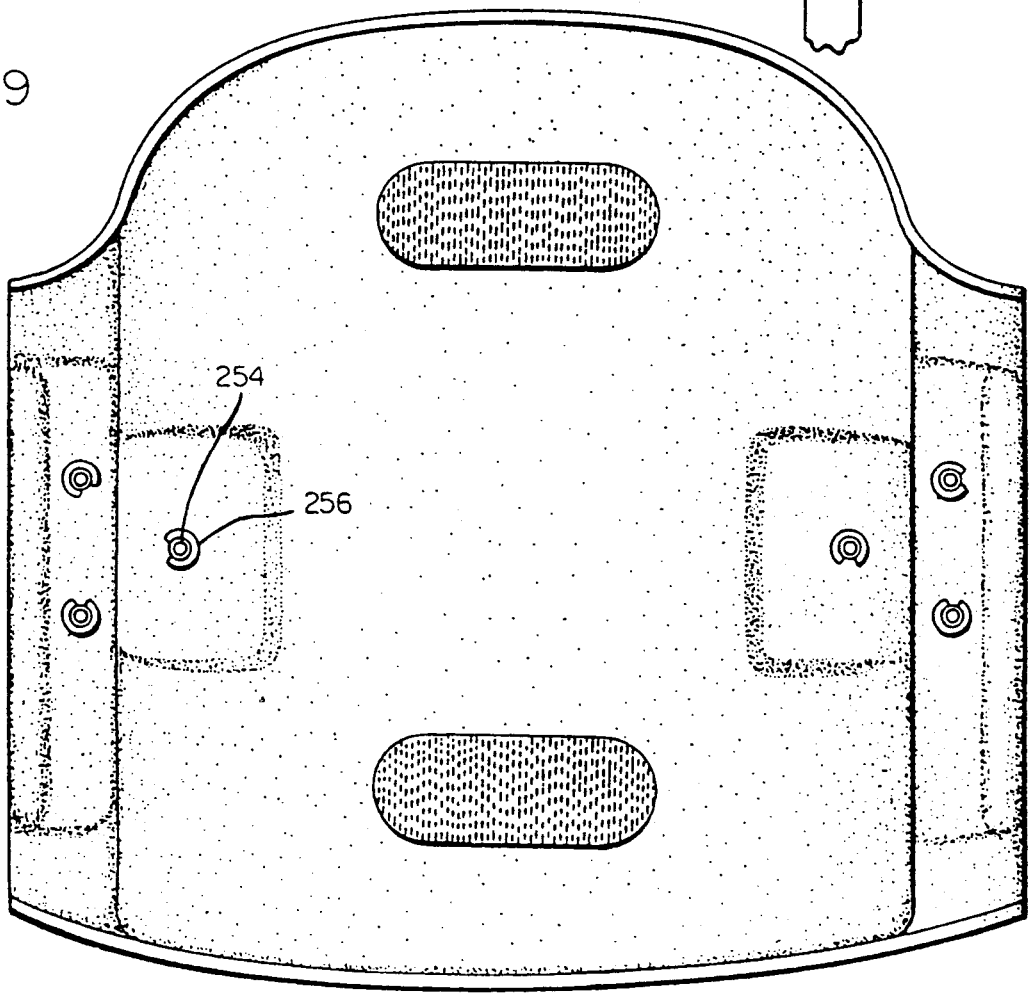
FIG. 9 is a front view of the wheelchair back system showing the attachment of the twist lock mounting system embodiment.

Pad 90 generally comprises an envelope 92 constructed of a front layer 94 and a back layer 96 of flexible material such as polyethylene or polyurethane. Layers 94 and 96 are heat sealed about the periphery 98, in order to form a container to hold flowable fluid 100. Pad 90 has at least one transverse lateral segment 102 formed by heat sealing front layer 94 to back layer 96 which divides pad 90 into a plurality of horizontally divided chambers. The transverse segment 102 prevents the flowable fluid 100 from flowing downwardly and thus maintains the flowable fluid throughout the entire height of pad 90. Preferably, a tube which is approximately 125% of the length of channel 80 may be filled with a required amount of flowable fluid, flattened and sealed at each end. The tube thus makes up both the front layer 94 and back layer 96 of pad 90. The tube is then heat sealed transversely at appropriate spacings to form transverse segments 102. The transversely sealed tube is then inserted in the channel and the extra 25% of material is draped over the transverse segments 102 as shown in FIG. 6, thus providing for flowable material between the transverse segments and the wheelchair user.

Alternatively, front layer 94 is puffed out during manufacture, so that the front layer 94 contains more material (more square inches of material) than back layer 96. The us of added material in the front layer 94 allows the front layer 94 to lap over transverse segment 102 as shown in FIG. 6, and thus allow the flowable fluid to come to rest over the transverse segment 102 and provide a cushioning material between the transverse segment 102 and the patient's back.

The Flowable Filling Material

The flowable fluid may be selected from a number of different fluid types. Gases, such as air may be used, but liquids such as water are preferable because the weight of the water provides more stability. However, it is preferred to employ as the fluid a highly viscous liquid, i.e., plastic or viscous thixotropic material, which flows gradually when pressure is applied to it, but which maintains its shape and position in the absence of pressure (hereinafter sometimes referred to as "plastic"). One such viscous fluid is commercially available under the trade name FLO-LITE, the registered trademark of Alden Laboratories. Suitable flowable materials are described and claimed in the U.S. Pat. Nos. listed below, which are incorporated by reference herein:

U.S. Pat. No. 3,237,319
U.S. Pat. No. 3,402,411
U.S. Pat. No. 3,635,849
U.S. Pat. No. 3,798,799
U.S. Pat. No. 4,038,762
U.S. Pat. No. 4,083,127
U.S. Pat. No. 4,108,928
U.S. Pat. No. 4,144,658
U.S. Pat. No. 4,229,546
U.S. Pat. No. 4,243,754
U.S. Pat. No. 4,255,202

Additionally, the flowable fitting material described in Applicant's patent application Ser. No. 017,711 filed Feb. 24, 1987, now U.S. Pat. No. 4,728,551, may be used as the flowable material in the practice of the present invention.

Lumbar Support

Lumbar support 120 is designed to fit in channel 80, but may be moved vertically to the position which most comfortably supports the lumber region of the wheelchair user. Lumbar support 120 may be produced from a solid piece of foam material, such as self-skinned polyurethane or polyethylene. Alternatively, the lumbar support may be a pad of the style used for 90, that is, filled with a flowable, viscous, thixotropic material.

Lumbar support 120 is affixed in the channel 80 through VELCRO strips (not shown) attached to the rear side of lumbar support 120 where they engage VELCRO strips which extend vertically up and down the length of channel 80. This allows the lumbar support to be positioned at the correct elevation, independent of the height at which the wheelchair back is set.

Figure 4:
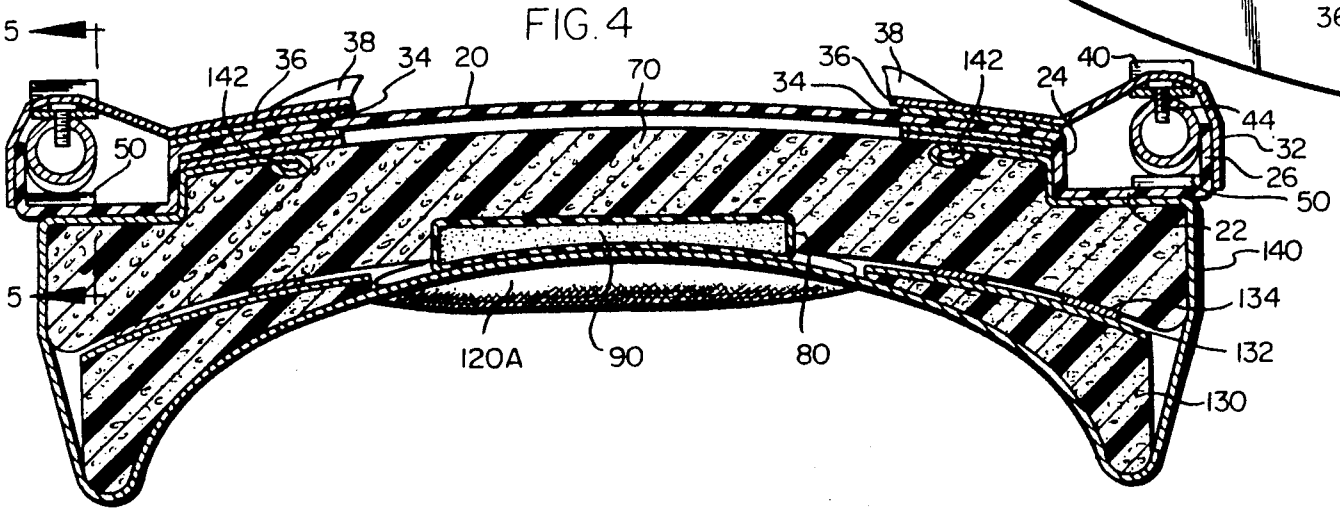
FIG. 4 is a cross-sectional top view of the wheelchair back system, taken at section 4—4 of FIG. 1.

Lumbar support 120 is designed to fit under pad 90 and thus thrust pad 90 forwardly in the region of the lumbar support as shown in FIG. 4—see 120A.

The Bolsters

Figure 12:
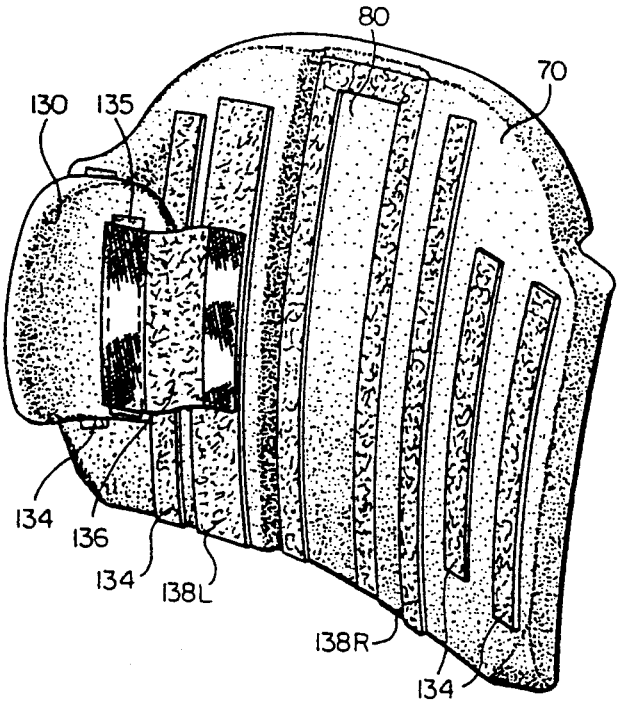
FIG. 12 is an isometric front view of the wheelchair back system, showing a bolster with the improved bolster attachment means.
Figure 13:
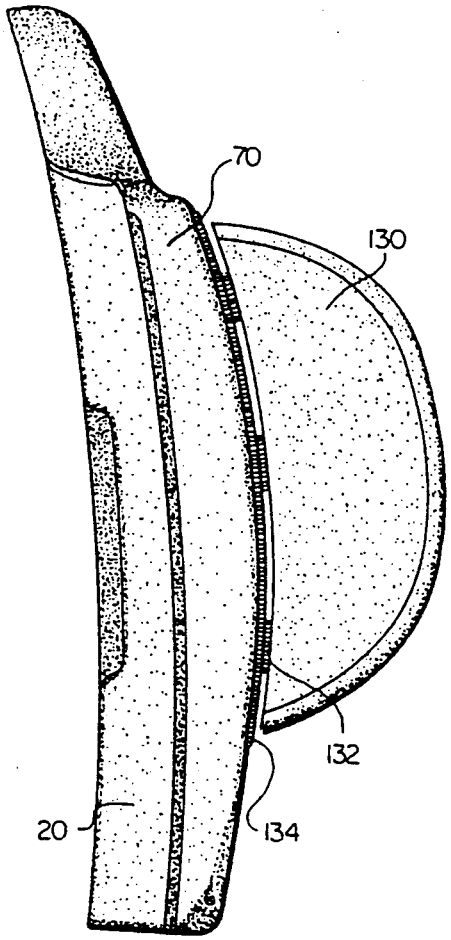
FIG. 13 is a side view of the wheelchair back system embodiment of FIG. 12.
Figure 14:
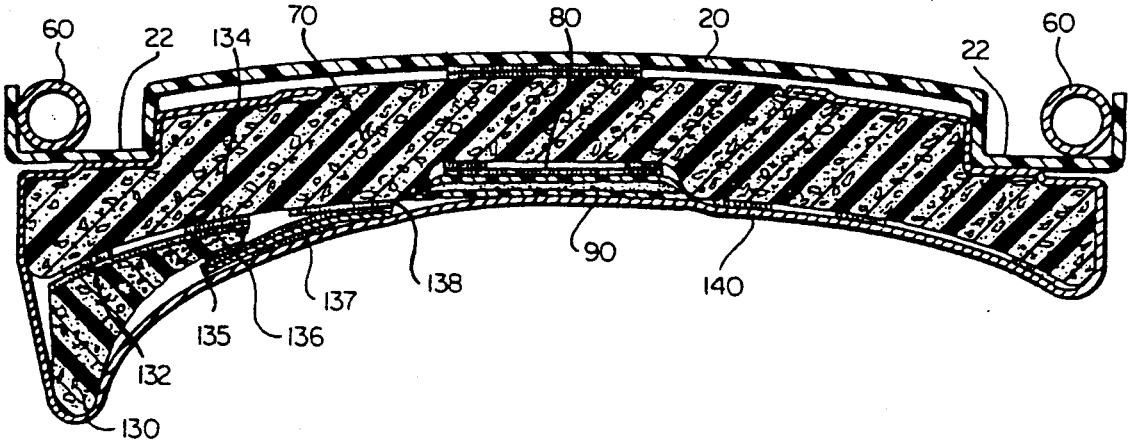
FIG. 14 is a cross sectional top view of the wheelchair back system embodiment of FIG. 12, taken at Section 4—4 of FIG. 1.

Bolsters 130 are designed to be removably affixed to the lateral portions of the front side of cushion 70 where they provide lateral support for the wheelchair occupant, as shown in FIGS. 12–14 inclusive. Preferably, a plurality of horizontal VELCRO strips 132 are adhered to the rear side of bolsters 130 where they engage vertical VELCRO strips 134 attached to the lateral portions of the front side of cushion 70. This attachment means allows for easy vertical and/or horizontal adjustment of the bolster position with respect to cushion 70.

In the preferred embodiment, vertical VELCRO strip 135 is affixed to the front surface of bolster 130. VELCRO strip 138 is affixed to the front side of cushion 70, toward the center of cushion 70. Strap 136 which is preferably a flexible member, has a rear surface covered with VELCRO 137 whereby strap 136 is adapted to be secured to the front side bolster 130 to VELCRO strip 135 and secured, at the same time, to VELCRO strip 137 on the front surface of cushion 70. In alternative embodiments, wherein VELCRO strip 134 is broad enough, strap 136 may engage the front side of bolster 130 through VELCRO strip 135 and be secured, at the same time, to VELCRO strip 134 on the front side of cushion 70. VELCRO strap 136 provides improved connection of bolster 130 to cushion 70 and in particular provides for enhanced resistance to lateral forces which may be applied to the bolster during use of the wheelchair. The use of strap 136 dramatically increases the lateral force required to dislodge the bolster from its selected position.

In the preferred embodiment, the shape of the back of bolster 130 compliments the shape of the front portion of cushion 70. As is more clearly shown in FIG. 13, the complimentary surfaces give a greater area of attachment and provide enhanced connection of the bolster to the cushion. The use of a bolster having a surface shape which is complimentary to the front side of the cushion also increases the lateral force required to dislodge the bolster from its selected position.

Alternatively, the strap 136 may be attached to the front surface of bolster 130 by adhesive for other means which provides for permanent attachment of said strap to said bolster. It is preferred, however, to have strap 136 removably affixed to said bolster so that the bolster may be most conveniently fitted to the wheelchair cushion back in the position most comfortable and desirable to the wheelchair user. After the preferred position has been established, the strap 136 is secured to the front of the bolster and to the wheelchair back, thus providing the enhanced attachment.

Vertical VELCRO 138 may be of various widths, as illustrated in FIG. 13, by strips 138L and 138R. Alternatively, if the width of VELCRO strip 134 sufficiently warrant, the strap 136 may engage VELCRO strip 134, with or without engaging VELCRO strip 138. Vertical strips 138 must be located on the central portion of said wheelchair back, that is, VELCRO strip 138 must be located inwardly from the position of bolster 130, and toward the center line of said wheelchair back cushion.

In the preferred embodiment, the wheelchair back is provided with two, symmetrical bolsters. However, the present invention contemplates a wheelchair back wherein a single bolster is used as well as a system wherein two bolsters of different size and/or configurations are used.

Alternatively, bolsters of the type disclosed in U.S. Pat. No. 3,542,421 may be used.

The Cover

Figure 1:
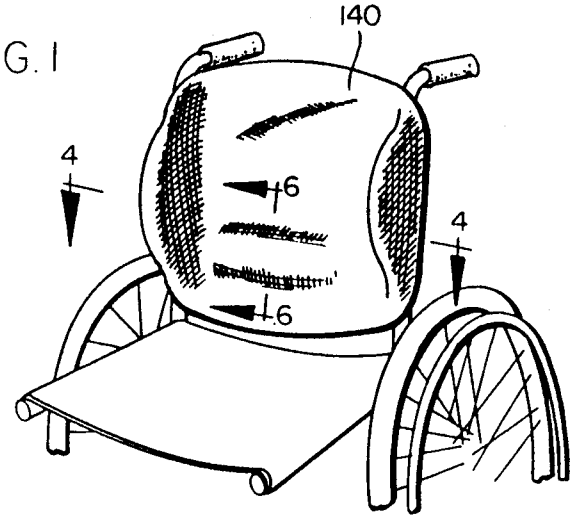
FIG. 1 is an isometric front view of the wheelchair back system, affixed to a wheelchair, with the cover in place thereon.

Cover 140 is designed to fit over cushion 70 and over bolsters 130 to provide the wheelchair back system with a streamlined, aesthetically pleasing appearance, as shown in FIG. 1. As shown by FIG. 4, the cover extends around to the rear of cushion 70. Preferably, elastic means 142 is positioned at the edge of cover 140 in order to urge the cover edges to surround cushion 70. When cushion 70 is affixed to back 20, the edges of the cover 140 are held between cushion 70 and plastic shell 20. Elastic means 142 facilitates the positioning of the cover on cushion 70 before cushion 70 is affixed to the plastic shell 20. Preferably, the cover is lined with a reticulated, open-cell foam, in ¼ to ½ inch thickness, to encourage air circulation and provide extra comfort. Preferably, cover 140 has tucks of extra material sewn into the top and/or bottom to allow expansion of the cover when using bolsters 130.

The scope of the invention herein shown and described is to be considered only as illustrative. It will be apparent to those skilled in the art that numerous modifications may be made therein without departure from the spirit of the invention and the scope of the appended claims.

We claim:

1. A wheelchair back system comprising a back, a bolster, and an attachment means, said back having a front surface having lateral portions and a central portion;

said bolster having a rear surface adapted to be positioned upon one of said lateral portions of said back, said bolster having a front surface which includes a sloped portion adapted to provide lateral support to a wheelchair user, the rear surface of said bolster being removably affixed to one of said lateral portions of said back; and said attachment means comprising a strap attached to the front surface of said bolster, said strap member including means to removably engage the front surface of said back toward the center of said back, whereby said strap provides improved lateral attachment of said bolster to said back.

2. A wheelchair back system as defined in claim 1 wherein said strap is removably attached to said bolster.

3. A wheelchair back system as defined in claim 1, the rear surface of said bolster has a shape which is generally complimentary to the shape of one of said lateral portions of said back.

4. A wheelchair back system as defined in claim 1 wherein the front surface of said back is generally concavedly curved when viewed from above in a horizontal section, and said bolster has a convex surface which is complimentary to the concaved surface of said contoured back.

5. A wheelchair back system comprising a contoured cushion, bolster, and an attachment means, said contoured cushion having a front surface having lateral portions and a central portion, said lateral portions extending forward of said central portion, said bolster having a rear surface which is substantially complimentary to the front surface of one of said lateral portions of said cushion, said bolster having a front surface which includes a sloped portion adapted to provide lateral support to a wheelchair user, the rear surface of said bolster being removably affixed to one of said lateral portions of said cushion; and said attachment means comprising a strap attached to the front surface of said bolster, said strap including means to engage the front surface of said contoured cushion toward the center of said cushion, whereby said strap provides improved lateral attachment of said bolster to said contoured cushion.

6. A wheelchair back system as defined in claim 5 wherein said strap is removably attached to said bolster.

7. A wheelchair back system as defined in claim 5, the rear surface of said bolster has a shape which is generally complimentary to the shape of one of said lateral portions of said back.

8. A wheelchair back system as defined in claim 5 wherein the front surface of said cushion is generally concavedly curved when viewed from above in a horizontal section, and said bolster has a convex surface which is complimentary to the concaved surface of said contoured cushion.

9. A wheelchair back system comprising a contoured cushion, a bolster, and a attachment means, said contoured cushion having a frontal surface including lateral portions and a central portion, said cushion being generally concaved when viewed from above in a horizontal section, wherein said lateral portions of said cushion extend forward of said central portion, said bolster having a rear surface adapted to engage one of said lateral portions of said cushion, through said attachment means, whereby said bolsters are affixed to said cushion at a position forward of said central portion of said cushion the rear surface of said bolster being removably affixed to one of said lateral portions of said cushion; and said attachment means adapted to removably affix said bolster to the front surface of said lateral portions of said cushion at a selected height on said cushion, said attachment means comprising a strap attached to the front surface of said bolster, said strap having means to engage the front surface of said contoured cushion toward the center of said cushion, whereby said strap provides improved lateral attachment of said bolster to said contoured cushion.

10. A wheelchair back system as defined in claim 9 wherein said strap is removably attached to said bolster.

11. A wheelchair back system comprising a contoured cushion having a front surface which is generally concavedly curved, when viewed from above in a horizontal section, wherein the lateral portions of the front side of said cushion are forward of the central portion, said system further comprising a bolster having a convex surface which is complimentary to one of the lateral portions of said contoured cushion, said bolster being affixed to one of said lateral portions whereby said bolsters are positioned ahead of said central portion of said cushion, attachment means adapted to affix said bolster to one of said lateral portions of said cushion at a selected position independent of the height of said back, said attachment means further comprises a strap attached to the front surface of said bolster, said strap having means to engage the front surface of said contoured cushion toward the center of said cushion, whereby said strap provides improved lateral attachment of said bolster to said contoured cushion

12. A wheelchair back system as defined in claim 11 wherein said strap is removably attached to said bolster.

* * * * *